US005396707A

United States Patent [19]

Blase

[11] Patent Number: 5,396,707

[45] Date of Patent: Mar. 14, 1995

[54] TOOL FOR USE IN HANGING A DOOR

[76] Inventor: Danny Blase, 1202 Clayburn La., San Jose, Calif. 95121

[21] Appl. No.: 151,123

[22] Filed: Nov. 12, 1993

[51] Int. Cl.[6] ..... E04F 21/00

[52] U.S. Cl. ..... 33/194; 33/481; 33/451

[58] Field of Search ..... 33/194, 526, 404, 474, 33/478, 481, 451, 518

[56] References Cited

U.S. PATENT DOCUMENTS

| | | | |
|---|---|---|---|
| 1,115,030 | 10/1914 | Smith | 33/194 |
| 1,742,103 | 12/1929 | Sholtes | 33/404 |
| 1,762,664 | 6/1930 | Mott | 33/404 |
| 1,791,822 | 2/1931 | Lundquist | 33/194 |
| 2,679,696 | 6/1954 | Reeder, Jr. | 33/194 |

FOREIGN PATENT DOCUMENTS

| | | | |
|---|---|---|---|
| 3327556 | 2/1985 | Germany | 33/451 |
| 1596842 | 9/1981 | United Kingdom | 33/194 |

*Primary Examiner*—Thomas B. Will

[57] ABSTRACT

A tool for use in hanging a door, the tool comprising in combination a border element having a vertical component, a horizontal component, a first surface, a second surface, and a peripheral edge interconnecting the first and second surfaces with the peripheral edge having an inner extent defining the angle between the components and an outer extent formed opposite the inner extent; a plurality of vertical slots formed through the vertical component of the border element; a plurality of horizontal slots formed through the horizontal component of the border element; and a plurality of spacing tabs, the number of spacing tabs corresponding to the total number of horizontal and vertical slots, each tab adapted to be received within one of the horizontal or vertical slots.

4 Claims, 4 Drawing Sheets

TOOL FOR USE IN HANGING A DOOR

BACKGROUND OF THE INVENTION

1. Field of the Invention

The present invention relates to a tool for use in hanging a door and more particularly pertains to such a tool which insures the proper spacing between a door and a door jamb.

2. Description of the Prior Art

The use of door hanging devices is known in the prior art. More specifically, door hanging devices heretofore devised and utilized for the purpose of installing a door in a door jamb are known to consist basically of familiar, expected and obvious structural configurations, notwithstanding the myriad of designs encompassed by the crowded prior art which have been developed for the fulfillment of countless objectives and requirements.

For example, U.S. Pat. No. 3,834,034 to Berquist discloses an apparatus for use in marking doors for cutting. The apparatus includes an upright adapted to be suspended from the fixed hinge portions on a door.

U.S. Pat. No. 3,923,167 to Blankenbeckler discloses a door hanging device. The device is adapted to hold a heavy door in a plurality of positions whereby the door may be worked on.

U.S. Pat. No. 4,707,925 to Englehart discloses a door frame pattern device. The device can be placed within a door frame and adjusted to the dimensions of the door frame.

U.S. Pat. No. 5,048,806 to Deutsch et al discloses a door hanging aid. The aid includes two articulating U-shaped channel members respectively hinged at proximate ends.

Furthermore, U.S. Pat. No. 4,141,192 to Augustine discloses a door brace for facilitating hanging. The brace includes an L-shaped channel for mounting on the lower outside corner of a door.

In this respect, the tool according to the present invention substantially departs from the conventional concepts and designs of the prior art, and in so doing provides an apparatus primarily developed for the purpose of positioning a door within a door jamb.

Therefore, it can be appreciated that there exists a continuing need for new and improved tools which can be used in hanging doors. In this regard, the present invention substantially fulfills this need.

SUMMARY OF THE INVENTION

In view of the foregoing disadvantages inherent in the known types of door hanging devices now present in the prior art, the present invention provides an improved tool for use in hanging a door. As such, the general purpose of the present invention, which will be described subsequently in greater detail, is to provide a new and improved tool for use in hanging a door and method which has all the advantages of the prior art and none of the disadvantages.

To attain this, the present invention essentially comprises a tool for use in hanging a door, the tool comprising, in combination a border element having a vertical component and a horizontal component, the components being integral with, and formed 90 degrees relative to each other, the border element further including a first surface, a second surface, and a peripheral edge interconnecting the first and second surfaces, the peripheral edge having an inner extent defining the 90 degree angle between the components and an outer extent formed opposite the inner extent; a plurality of vertical slots formed through the vertical component of the border element, the vertical slots being formed at regular intervals along the entire length of the vertical component; a plurality of horizontal slots formed through the horizontal components of the border element, the horizontal slots being formed at regular intervals along the entire length of the horizontal component; a plurality of vertical apertures formed within the outer extent of the peripheral edge of the horizontal component of the border element, each vertical aperture formed adjacent a corresponding horizontal slot; a plurality of horizontal apertures formed within the outer extent of the peripheral edge of the vertical component of the border element, each horizontal aperture formed adjacent a corresponding vertical slot; a plurality of spacing tabs, the number of spacing tabs corresponding to the total number of horizontal and vertical slots, each tab adapted to be received within one of the horizontal or vertical slots; and a plurality of set screws, the total number of set screws corresponding to the number of vertical and horizontal apertures, each set screw adapted to be received within one of the horizontal and vertical apertures, each set screw functioning to secure a tab within its corresponding slot.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved tool for use in hanging a door which has all the advantages of the prior art tools and none of the disadvantages.

It is another object of the present invention to provide a new and improved tool for use in hanging a door which may be easily and efficiently manufactured and marketed.

It is a further object of the present invention to provide a new and improved tool for use in hanging a door which is of a durable and reliable construction.

An even further object of the present invention is to provide a new and improved tool for use in hanging a door which is susceptible of a low cost of manufacture with regard to both materials and labor, and which accordingly is then susceptible of low prices of sale to the consuming public, thereby making such tools for use in hanging a door economically available to the buying public.

Still yet another object of the present invention is to provide a new and improved tool for use in hanging a door which provides in the apparatuses and methods of the prior art some of the advantages thereof, while simultaneously overcoming some of the disadvantages normally associated therewith.

Still another object of the present invention is to hang a door with a tool which serves to aid in positioning the door within the jamb.

Yet another object of the present invention is to space a door with respect to a jamb by a gauge for the space between the edge of the door and the adjacent edge of the door jamb.

Even still another object of the present invention is to provide a new and improved tool for use in hanging a door, the tool comprising in combination a border element having a vertical component, a horizontal component, a first surface, a second surface, and a peripheral edge interconnecting the first and second surfaces with the peripheral edge having an inner extent defining the angle between the components and an outer extent formed opposite the inner extent; a plurality of vertical slots formed through the vertical component of the border element; a plurality of horizontal slots formed through the horizontal component of the border element; and a plurality of spacing tabs, the number of spacing tabs corresponding to the total number of horizontal and vertical slots, each tab adapted to be received within one of the horizontal or vertical slots.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
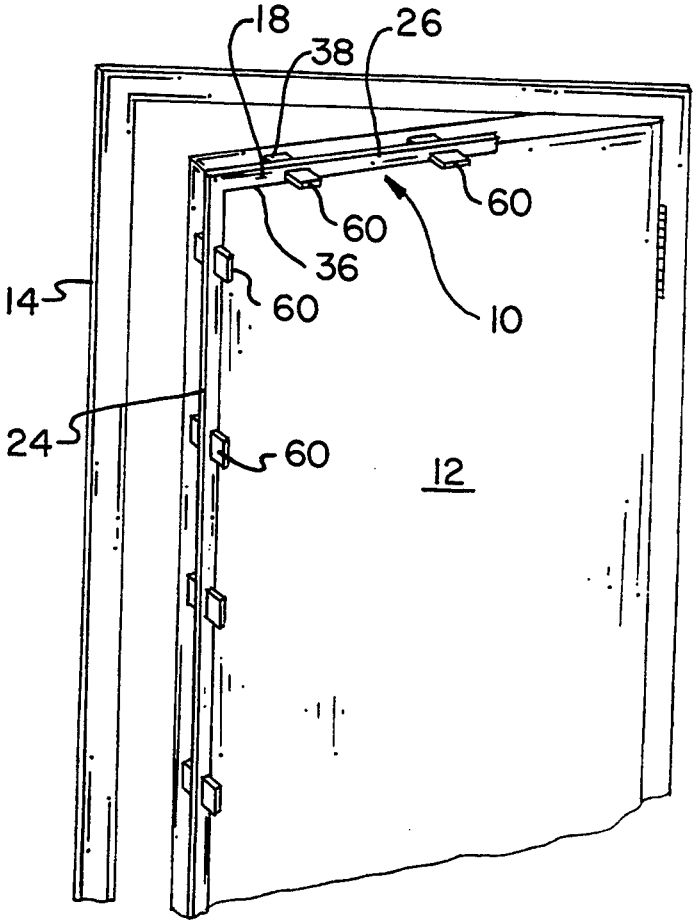
FIG. 1 is a perspective view of the tool in accordance with the first embodiment of the present invention.
Figure 3:
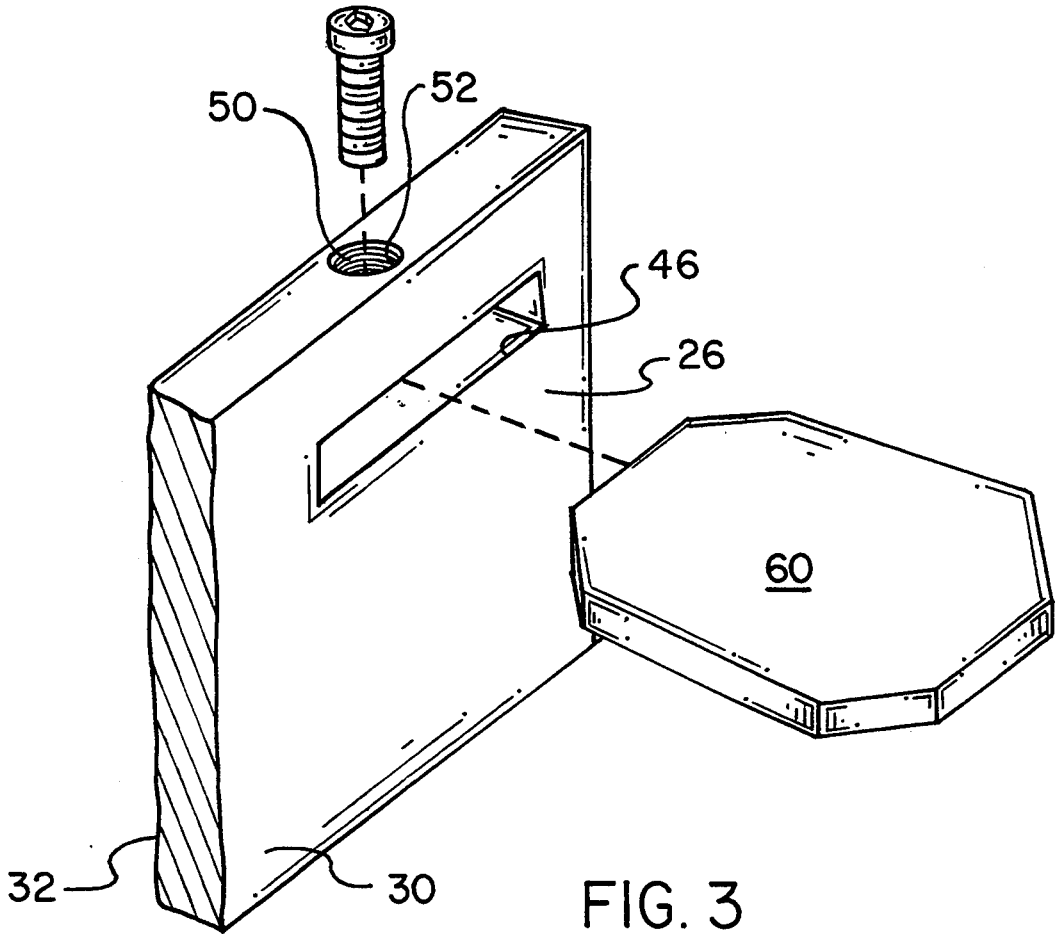
FIG. 3 is an enlarged view of the tab and slot arrangement in accordance with the present invention.
Figure 4:
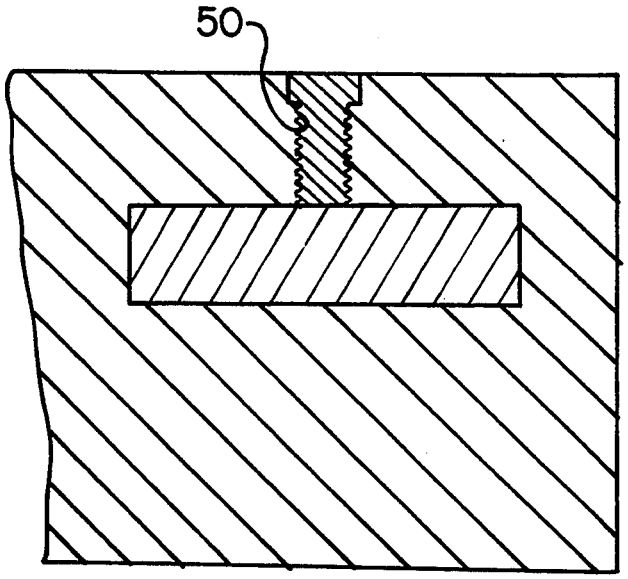
FIG. 4 is a cross sectional view of the tab and slot arrangement in accordance with the present invention.
Figure 5:
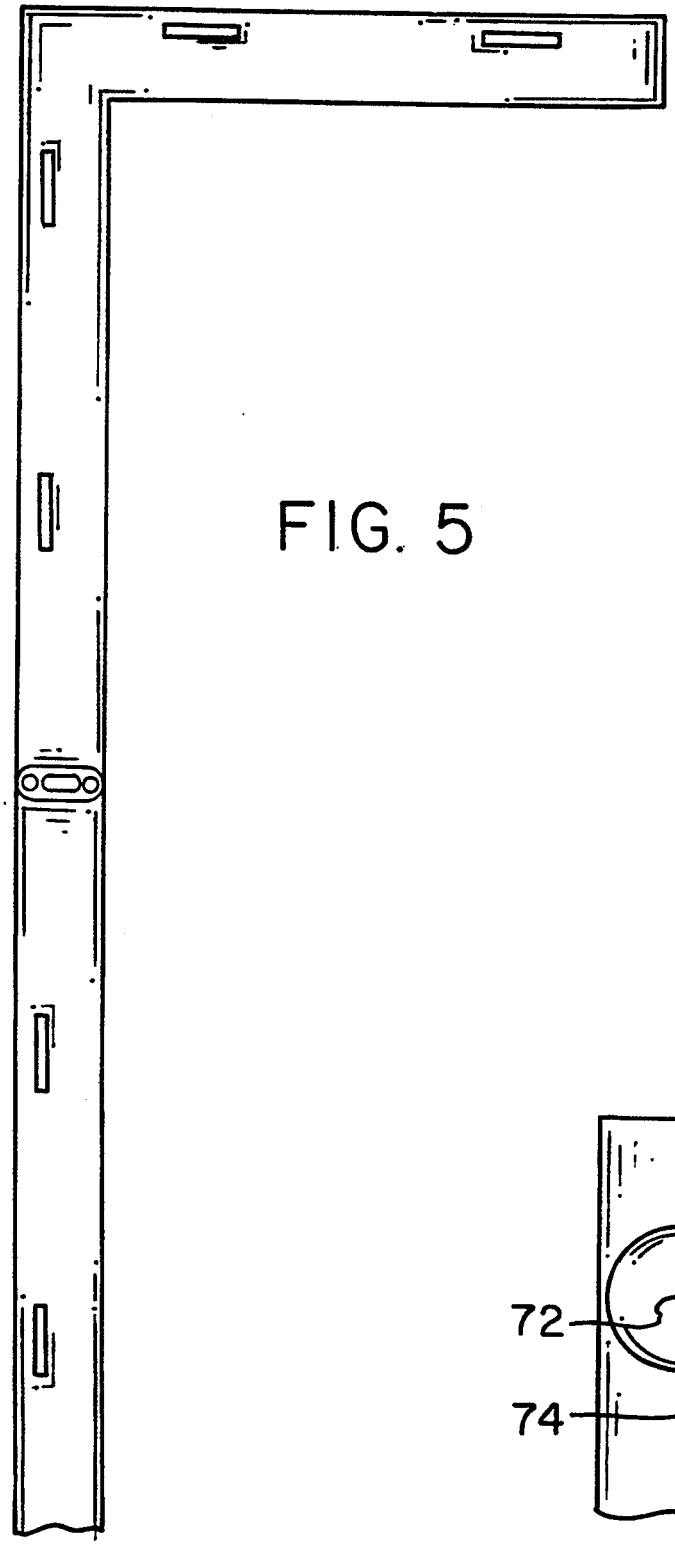
FIG. 5 is a view of the tool in accordance with the second embodiment of the present invention.
Figure 6:
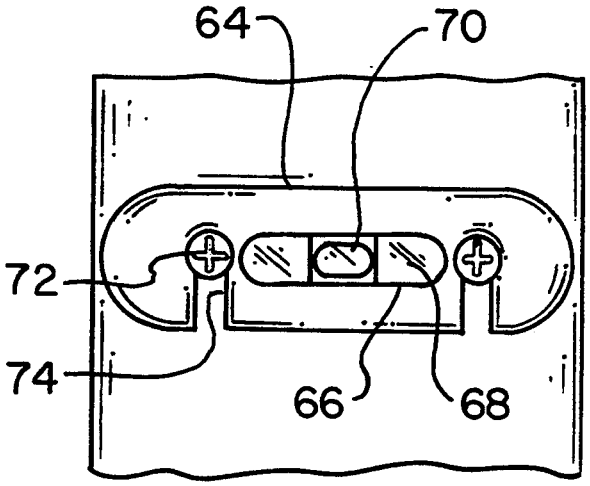
FIG. 6 is a view of the leveling device in accordance with the second embodiment of the present invention.
Figure 7:
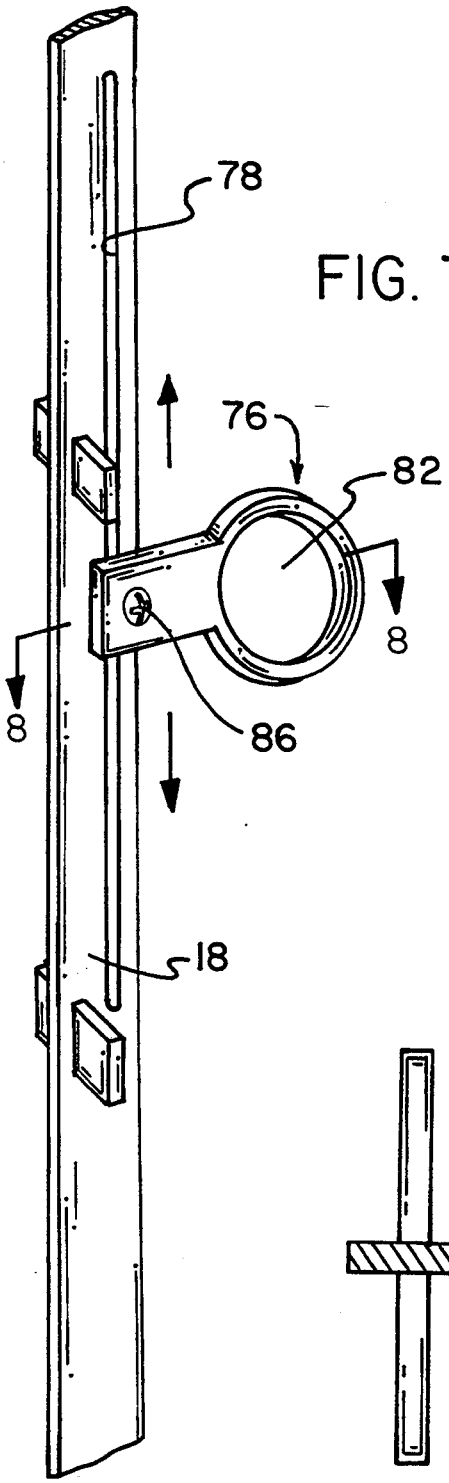
FIG. 7 is a perspective view of the tool in accordance with the third embodiment of the present invention.
Figure 8:
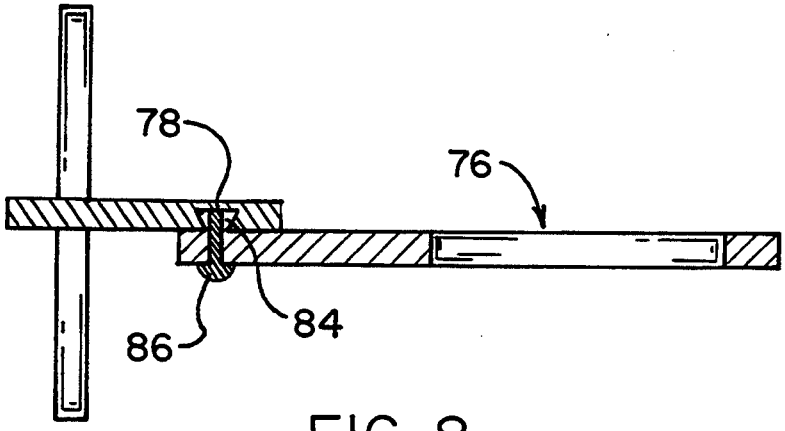
FIG. 8 is a view taken along line 8—8 of FIG. 7.

With reference now to the drawings, and in particular to FIG. 1 thereof, a new and improved tool for use in hanging a door embodying the principles and concepts of the present invention and generally designated by the reference numeral 10 will be described.

The present invention relates to a tool 10 for use in hanging a door 12. The tool 10 serves two purposes, first the tool insures the proper orientation between a door 12 to be hung and the surrounding door jamb 14, and second the tool 10 insures the existence of the proper spacing between a hung door 12 and the surrounding jam 14. The tool 10 accomplishes its purposes with two principal components, a border element 18, and a series of tabs 20 secured within, and perpendicular to, the border element 18.

The border element 18 is an L-shaped straight edged implement which is preferably constructed of a light weight metal such as aluminum. The border element includes a vertical component 24 and a horizontal component 26. In the preferred embodiment the vertical component 24 measures 6 feet 8 inches while the horizontal component measures 12 inches. Although the dimensions are given here for the preferred embodiment the tool can be formed to match any dimensional specifications.

The horizontal and vertical components 24 and 26 are integral with, and formed 90 degrees relative to, each other. Thus, in the simplest sense, the border element can be employed like a conventional T-square. In this sense, the element can be place adjacent one of the corners of a door 12 with the element serving to aid in the comparison between the orientation of the door 12 and the door jamb 14.

Figure 2:
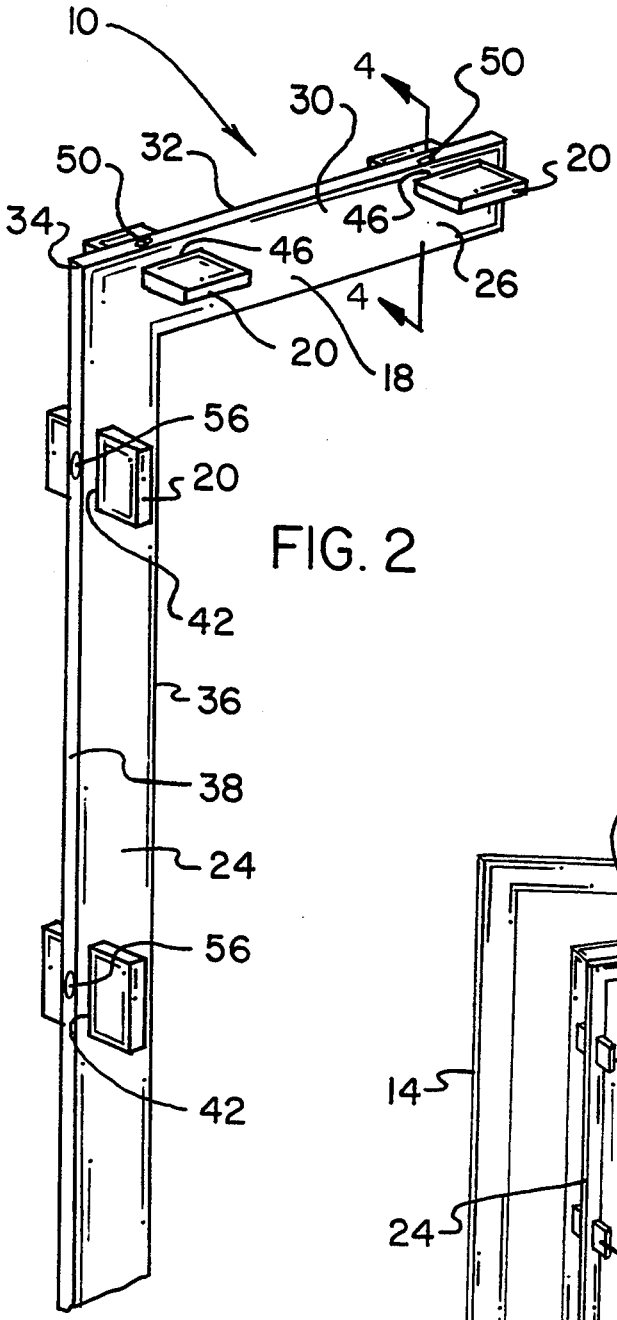
FIG. 2 is a perspective view of the tool of FIG. 1 in use upon a door.

As is apparent from the showings of FIGS. 1 and 2, the construction the border element includes a first surface 30, a second surface 32, and a peripheral edge 34 interconnecting the first and second surfaces. The peripheral edge includes an inner extent 36 defining the 90 degree angle between the components and an outer extent 38 formed opposite the inner extent 36.

The border element 18 further includes a plurality of vertical slots 42 formed through the vertical component 24 of the border element 18. The vertical slots 42 are formed at regular intervals along the entire length of the vertical component. In the preferred embodiment, the total number of vertical slots is seven with a 12 inch spacing between the centers of adjacent slots. Although the number and spacing of slots is given for the preferred embodiment, the present invention is by no means limited to such number and spacing.

Additionally, a plurality of horizontal slots 46 are formed through the horizontal component 26 of the border element 18. The horizontal slots 46 are formed at regular intervals along the entire length of the horizontal component 26. In the preferred embodiment the total number of horizontal slots 46 is two with a 12 inch spacing between the centers of adjacent slots 46.

The border element 18 further includes a plurality of vertical apertures 50 formed within the outer extent 38 of the peripheral edge 34 of the horizontal component 26. Each vertical aperture 50 is formed adjacent a corresponding horizontal slot 46. Furthermore, each vertical aperture 50 is formed such that it extends to, and communicates with, a corresponding horizontal slot 46. The vertical apertures 50 are cylindrical in shape and employ an internal threading 52.

A plurality of horizontal apertures 56, similar in construction to the vertical apertures, 50, are formed within the outer extent 38 of the peripheral edge 34 of the vertical component 24. Each of the horizontal apertures 56 is formed adjacent to a corresponding vertical slot 42. Furthermore, each horizontal aperture has threads 52 and extends to, and communicates with, a corresponding vertical slot 42.

Each of the above described slots is adapted to receive a spacing tab 20. Thus, the number of spacing tabs 20 the tool 10 employs corresponds to the total number of horizontal and vertical slots 42 and 46. In the preferred embodiment, the total number of spacing tabs 20 employed is nine. In the preferred embodiment, the dimensions of the tab are 1 inch wide, 17/8 inches long, and 0.090 inch thick.

Set screw 64 are threadably received within each of the apertures 50 and 56 of the outer extent 38 of the peripheral edge 34. Thus, the total number of set screws 64 corresponds to the number of vertical and horizontal apertures 50 and 56. Each set screw 64 functions to secure a tab 20 within its corresponding slot.

Thus, with the tabs secured within the border element, extending from at least one face thereof, the tool 10 can function to insure the proper spacing between a door 12 and a door jamb 14. With the border element in place adjacent a corner of a door 12, the tabs 20 can be inserted between the edge of a door 12 and a door jamb 14. Thus, with the tab thickness serving to gauge the spacing between the edge of the door and the door jamb, the selection of tab thickness is important.

In the second embodiment of the present invention a level indicator 65 is secured to border element. The level indicator includes a see through container 66. The container is formed from a transparent glass or plastic material. The see through container serves to hold an amount of liquid 68. Furthermore, a small air pocket 70 is formed within the amount of liquid. The air pocket functions to indicate a level orientation. The leveling device as described does not depart substantially from conventional leveling devices. However, the leveling device of the present invention is small and is removably secured by screws 72 to slots 74 in one of the surfaces of the border element 18.

In the third embodiment of the present invention a sliding door knob locator 76 is slidably received along the border element 18. This is in part accomplished by a groove 78 formed within the vertical component 24 of the border element 18. The door knob locator 76 has a first end and a second end. A circular element 82 is positioned at the first end of the locator, and a protrusion 84 is positioned at the second end of the locator. The protrusion 84 is adapted to be inserted within and slide along the groove 78 of the vertical component. The groove 78 and protrusion 84 take the form of mating dovetail shaped members. A screw 86 extends through the locator 76 and into the protrusion 84 for securing the locator 76 with respect to the border element 18 and door 12. Thus, as described the door knob locator 76 provides a device which can be moved along the surface of the door and employed as a template to indicate where a door knob should be located on the door.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A tool for use in hanging a door, the tool comprising, in combination:

a border element having a vertical component and a horizontal component, the components being integral with, and formed 90 degrees relative to each other, the border element further including a first surface, a second surface, and a peripheral edge interconnecting the first and second surfaces, the peripheral edge having an inner extent defining the 90 degree angle between the components and an outer extent formed opposite the inner extent;

a plurality of vertical slots formed through the vertical component of the border element, the vertical slots being formed at regular intervals along the entire length of the vertical component;

a plurality of horizontal slots formed through the horizontal component of the border element, the horizontal slots being formed at regular intervals along the entire length of the horizontal component;

a plurality of vertical apertures formed within the outer extent of the peripheral edge of the horizontal component of the border element, each vertical aperture formed adjacent to and in communication with a corresponding horizontal slot;

a plurality of horizontal apertures formed within the outer extent of the peripheral edge of the vertical component of the border element, each horizontal aperture formed adjacent to and in communication with a corresponding vertical slot;

a plurality of spacing tabs with each spacing tab having a thickness, the number of spacing tabs corresponding to the total number of horizontal and vertical slots, each spacing tab adapted to be received within one of the horizontal or vertical slots, the spacing tabs further adapted to be positioned between an edge of a door and a door jamb with the thickness of the spacing tabs serving as a gauge to spacing between the edge of the door and the door jamb; and a plurality of set screws, the total number of set screws corresponding to the number of vertical and horizontal apertures, each set screw adapted to be received within one of the horizontal and vertical apertures, each set screw functioning to secure a tab within its corresponding slot.

2. A tool for use in hanging a door, the tool comprising, in combination:

a border element having a vertical component, a horizontal component, a first surface, a second surface, and a peripheral edge interconnecting the first and second surfaces with the peripheral edge having an inner extent defining the angle between the components and an outer extent formed opposite the inner extent;

a plurality of vertical slots formed through the vertical component of the border element;

a plurality of horizontal slots formed through the horizontal component of the border element; and a plurality of spacing tabs, the number of spacing tabs corresponding to the total number of horizontal and vertical slots, each spacing tab adapted to be received within one of the horizontal or vertical slots, the spacing tabs further adapted to be positioned between an edge of a door and a door jamb with the thickness of the spacing tabs serving as a gauge to spacing between the edge of the door and the door jamb.

3. The tool as described in claim 2 further comprising:

a level indicator having a see through container, the see through container holding an amount of liquid, a small air pocket formed within the amount of liquid, the air pocket functioning to indicate a level orientation and means to removably secure the level indicator to one of the surfaces of the border element.

4. The tool as described in claim 2 further comprising:

a groove formed within the vertical component of the border element; and a door knob locator having a first end and a second end, a circular element positioned at the first end of the locator, a protrusion positioned at the second end of the locator, the protrusion adapted to be inserted within and slide along the groove.

* * * * *